US006267660B1

(12) United States Patent
Jespersen

(10) Patent No.: US 6,267,660 B1
(45) Date of Patent: Jul. 31, 2001

(54) ROTATABLE GRINDING OR POLISHING TOOL, AN APPARATUS WITH SUCH A TOOL AND A METHOD FOR GRINDING OR POLISHING

(76) Inventor: Poul Erik Jespersen, Lyngvænget 6, DK-7870, Roslev (DK), 7870

( * ) Notice: Subject to any disclaimer, the term of this patent is extended or adjusted under 35 U.S.C. 154(b) by 0 days.

(21) Appl. No.: 09/492,799

(22) Filed: Jan. 28, 2000

(30) Foreign Application Priority Data

Feb. 2, 1999 (DK) ..... 1999 00133
Jan. 20, 2000 (DK) ..... 2000 00093

(51) Int. Cl.[7] ..... B23F 21/03

(52) U.S. Cl. ..... 451/550; 451/548; 451/904; 15/179; 15/183; 15/230.16; 15/4

(58) Field of Search ..... 451/550, 548, 451/904; 15/905, 4, 179, 183, 230.16, 230

(56) References Cited

U.S. PATENT DOCUMENTS 2,088,393 * 7/1937 Waldron ..... 451/551
4,461,127 * 7/1984 Hanger ..... 15/230.16
5,452,490 * 9/1995 Brundula et al. ..... 15/179
5,782,682 * 7/1998 Han et al. ..... 451/551

* cited by examiner

*Primary Examiner*—Derris H. Banks
*Assistant Examiner*—Lee Wilson
(74) *Attorney, Agent, or Firm*—James Creighton Wray; Meera P. Narasimhan

(57) ABSTRACT

The invention concerns a rotatable grinding/polishing tool, an apparatus with such a tool and a method for using such a tool. The tool has grinding elements in the shape of grinding/polishing flaps extending radially outward from a roller. Reinforcing support brushes also extend radially outward and adjacent to the flaps. Furthermore, the tool has holding elements, preferably in the shape of brushes, likewise extending radially outwards from the roller. The holding brushes have substantially lesser length than the flaps and the reinforcing support brushes. At the same time, the tangential stiffness of the holding brushes is considerably greater than the tangential stiffness of the flaps and the support brushes. The length of the grinding flaps is preferably so that by grinding or polishing, the flaps are capable of extending beyond an adjacent holding element.

10 Claims, 5 Drawing Sheets

Figure 1:
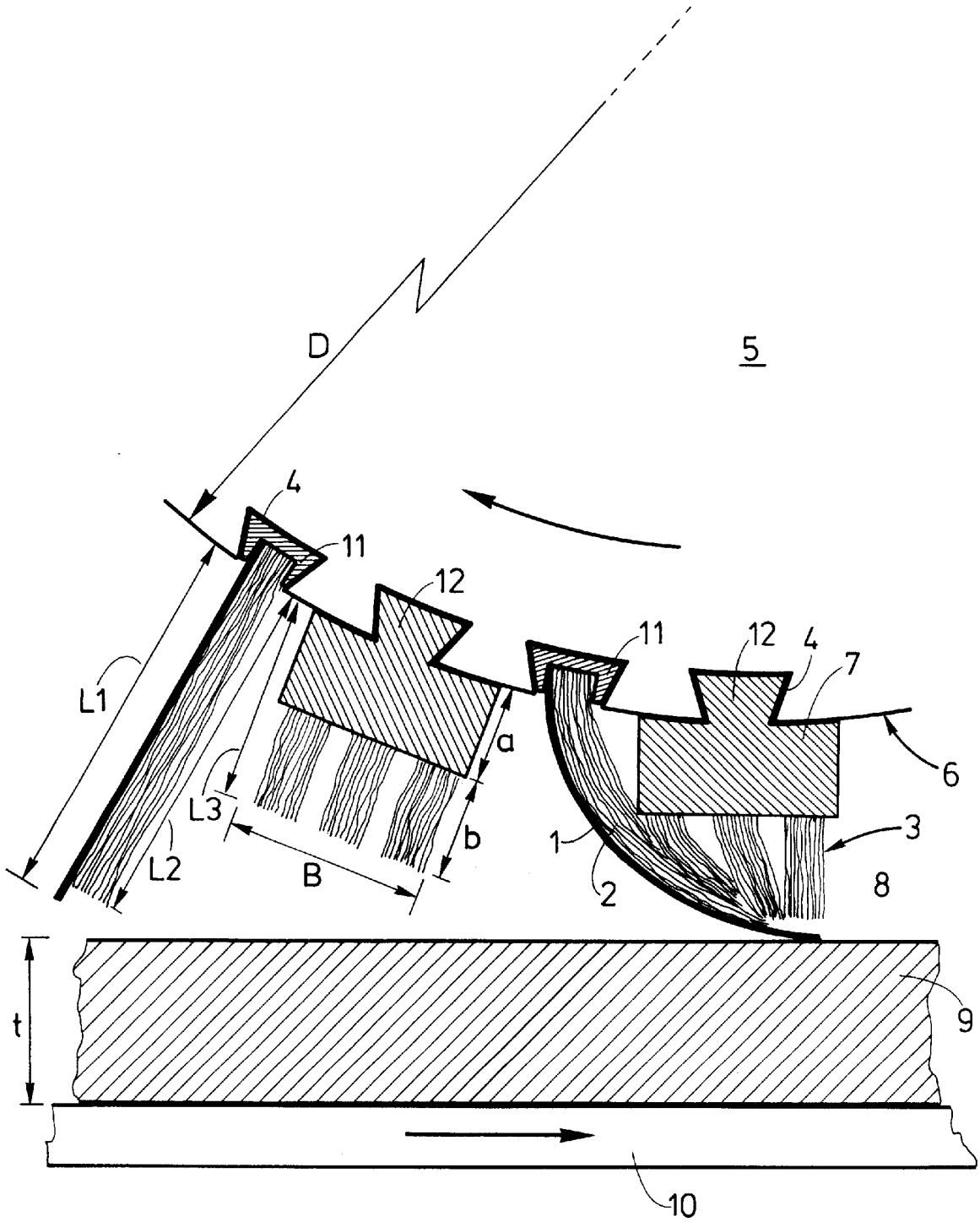

ROTATABLE GRINDING OR POLISHING TOOL, AN APPARATUS WITH SUCH A TOOL AND A METHOD FOR GRINDING OR POLISHING

The present invention concerns a rotatable grinding or polishing tool with grinding elements each mounted in a cylinder surface, which grinding elements comprise flaps of abrasive cloth and support brushes having substantially the same radial extension as the flaps and provided in close contact with these flaps.

The invention furthermore concerns an apparatus comprising support means for advancing an item with a certain thickness to be ground or polished and a rotatable grinding or polishing tool mounted above the support means and having grinding elements that are mounted in a cylinder surface, the grinding elements comprising flaps of abrasive cloth and support brushes which have substantially the same radial extension as the flaps and which are provided in close contact with these flaps.

Furthermore, the invention concerns a method for grinding plane substantially plane items by using a grinding or polishing tool according to any preceding claim which is pressed against the item.

By grinding or polishing plane items in apparatuses according to prior art, the items are placed on a rolling table, a belt conveyor or the like, whereby they are continually passed through the apparatus. The grinding elements of the rotating tool are brought into contact with the surface. Today this is only used for grinding or polishing items with profiled surfaces where it is possible for the grinding flaps to perform an efficient grinding at the bottom and at the sides of the profile of the surface.

It is prior art to make rotatable grinding or polishing tools, preferably for the furniture industry, where grinding elements constituted by flaps of abrasive cloth or sandpaper and reinforcing support brushes are disposed in axial direction of the rotatable tool. Such tools are traditionally used in connection with grinding or polishing profiled items. These tools are not capable of performing stronger and more aggressive grinding or polishing of plane items.

Therefore, belt polishers are used for grinding and polishing plane items, by which it is possible to exert a relatively large pressure on the back side of a rotating belt-shaped sandpaper which is thus pressed against the surface to be ground or polished. Because of friction and thereby heat formation, there is a great risk that varnish sticks to the sandpaper and renders it unserviceable after short time of use. The belt polishers are furthermore disadvantageous as they only are usable for grinding /polishing of substantially plane surfaces.

In certain situations by the plane grinding there is a wish for achieving a so-called flamed surface, i.e. with variation in the surface structure depending on the hardness and veining of the wood, and possibly on the kinds of varnish used and the varnish thicknesses. In order to achieve a flamed surface one has previously used segmented thrust pads in wide band polishers. Such segmented thrust pads imply, however, complicated and in certain circumstances costly constructions in connection with grinding and polishing wood in the furniture industry.

With prior art rotating polishing tools it is possible to perform an intermediate polishing or an intermediate grinding of varnished items. This, however, requires great rotational speeds in order to achieve sufficient grinding efficiency. Hereby heat formation occurs so that ground varnish and dust sticks between the grinding grains on the flaps. The heat formation may be reduced by reducing the rotational speed of the rotating tool. However, this implies that the grinding or polishing may not be performed with necessary efficiency and quality. The surface after the grinding or polishing may thus be non-uniform depending on variation in hardness of the treated surface.

The purpose of the present invention is to provide a grinding or polishing tool and an apparatus of the kind mentioned in the introduction which makes possible to perform plane polishing or plane grinding, particularly of varnished surfaces, without the problems of heat formation and clogging of the grinding elements, and which is capable of establishing a so-called flamed surface on a wood item in a technically simple way.

This purpose is achieved with a rotatable grinding or polishing tool which is peculiar in that between each grinding element there is provided a holding element which has substantially shorter radial extension than the grinding elements and which comprises holding means with a substantially greater stiffness in tangential direction than the support brushes.

The apparatus according to the invention is peculiar in that between each grinding element there is provided a holding element having substantially shorter radial extension than the grinding elements and comprising holding means with a substantially greater stiffness in tangential direction than the support brushes.

The method according to the invention is peculiar in that the tool is pressed against the item with such a force that the grinding flaps and the support brushes are bent in over the upper side of the holding element.

By using the holding elements it is possible to thrust the tool against the item with such a pressure that the grinding flaps and the support brushes are bent in over the upper side of the holding elements.

The grinding elements and the holding elements may be directly fastened in the cylinder surface or be fastened thereto via mouldings which may be accommodated in undercut grooves in the cylinder surface.

By using a tool according to the present invention it is possible to press the grinding or polishing tool against the surface of an item with relatively great force in order to establish a relatively large grinding/polishing pressure. At the same time, the rotational speed of the rotating tool may be reduced considerably. This correspondingly reduces the heat formation. Then it becomes possible to perform grinding or polishing of the item with great efficiency and without risk of too large heat formation. Therefore, it is possible to achieve efficiency and quality as known from plane grinding with belt polishers.

The holding elements are preferably provided in a holder which may be accommodated in undercut grooves between the grinding elements. The holding brushes extend likewise axially along the grinding or polishing tool. However, the holding brushes extend radially only about half as far out as the flaps and the reinforcing support brushes. The holding brushes and the grinding elements are arranged with mutual radial length so that there is no risk of the grinding flaps of the tool coming into contact with support means for advancing the item through an apparatus.

In a preferred embodiment, the tool is peculiar in that the holding element is an additional brush, and that the holding means are brush hairs.

The tool according to the invention thus has grinding/polishing flaps which are support by reinforcing support brushes. As in the prior art grinding or polishing tools, the flaps and the reinforcing support brushes have substantially the same radial length as the flaps, however, are a little longer than the support brushes. When brush hairs are used for the holding element, these will have a lesser radial length than the flaps and the reinforcing support brushes, respectively. Thereby a substantially greater stiffness in tangential direction appears as compared with the reinforcing support brushes. Hereby the brush hairs in the holding brushes are not bent, and thereby it becomes possible to support the grinding flaps and the support brushes against the upper side of the holding brushes. It is possible to use an optional combination of shorter brush hair and/or stiffer brush hairs in order to achieve the desired stiffness.

The holding brushes in the present invention are preferably fastened to solid brush holders or raised ribs extending radially outward over a certain distance over the cylinder surface of the roller of the tool, and where the brush hairs extend radially further outward from the solid brush holders. By using raised ribs or letting the solid brush holder extend a certain distance radially outward, it is possible to provide the outer ends of the brush hairs of the holding brush at greater radial position while maintaining great tangential stiffness of the brush hairs. This would not be the case if the holding brushes by themselves should extend from the circumference of the cylinder surface of the roller of the grinding or polishing tool itself.

Due to the construction of the grinding or polishing tool with grinding elements supported by the holding elements that are considerably stiffer in tangential direction as compared with the reinforcing support brushes, it will be possible at the same time to achieve a flamed surface on a wood item which is processed with a tool according to the invention.

With prior art rotating polishing tools for polishing varnished surfaces, and especially surfaces varnished with water based thermoplastic varnishes, it is common to perform polishing with a rotational speed of 350–450 rpm with reduced polishing pressure, at least in order to minimise the risk of the varnish sticking to the flaps. By such low rotational speeds, remains of varnish and possible fiber raising in the wood are, however, not removed adequately.

With a tool and an apparatus according to the present invention it will be possible to reduce the rotational speed to 75–150 rpm for a tool with a corresponding diameter, which completely eliminates the risk of the varnish sticking to the flaps. Because of the lower rotational speed and the method according to the present invention, it is possible at the same time to increase the grinding/polishing pressure. This implies that while the varnish problems are eliminated, at the same time there is also achieved a sufficiently good grinding or polishing which removes both possible varnish remains and possible fibre raising.

In order to reduce the drawback with remaining varnish remains after grinding or polishing, it has previously been normal practice to use relatively great thicknesses of varnish for having something to grind or polish and so that possible varnish remains did not have so great influence on the final result. With the tool according to the present invention, it is possible to reduce the varnish thicknesses to between one third and one fifth as the polishing takes place by a higher polishing pressure and with lower rotational speed, whereby the polishing becomes more uniform.

The use of the tool according to the invention is especially advantageous for intermediate grinding or intermediate polishing of surface varnished with water based, thermoplastic varnishes. However, the tool may also advantageously be used in connection with UV-varnishes which are not subjected to the detrimental action of heat as with polishing with prior art tools.

Figure 2:
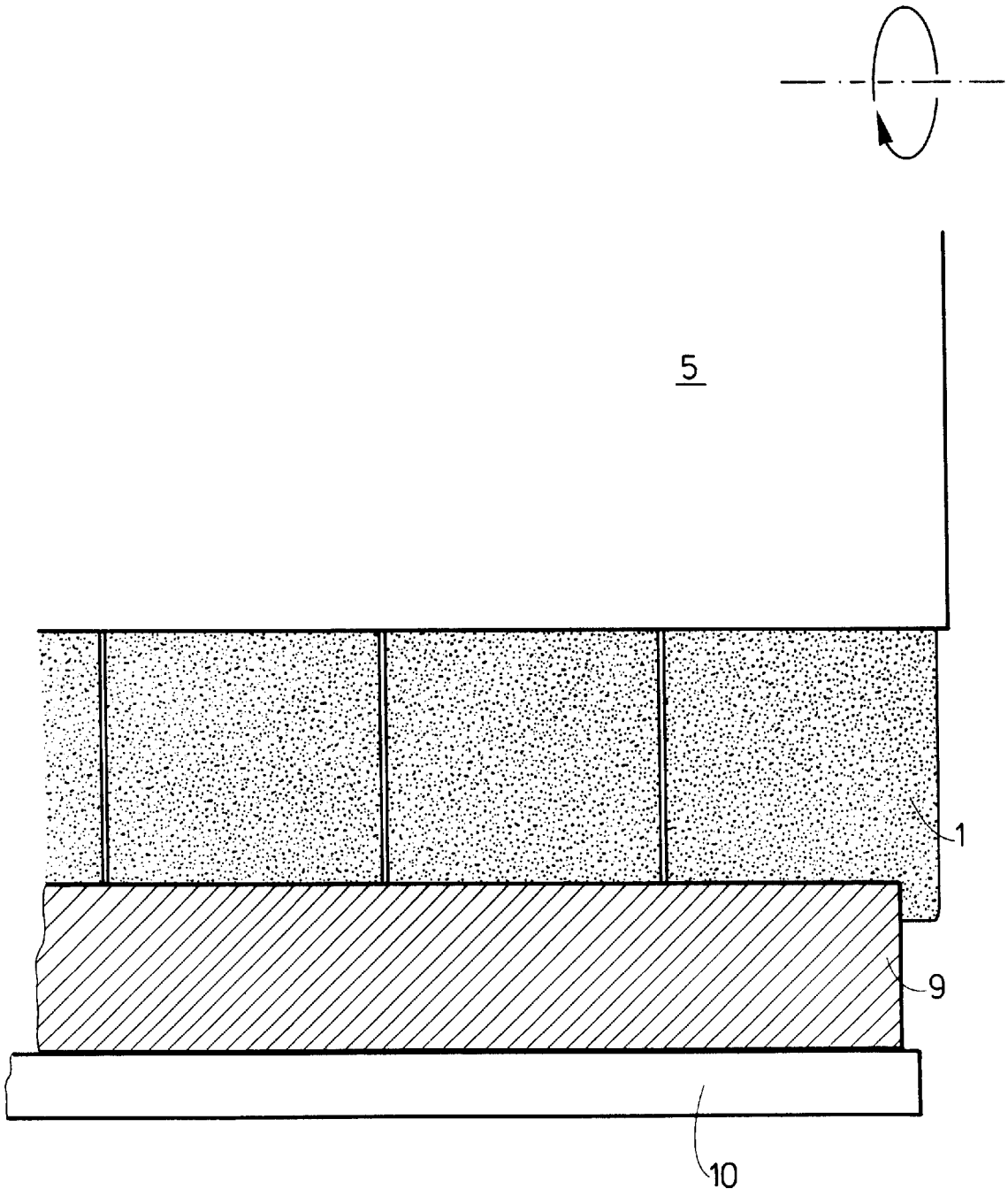
Figure 3:
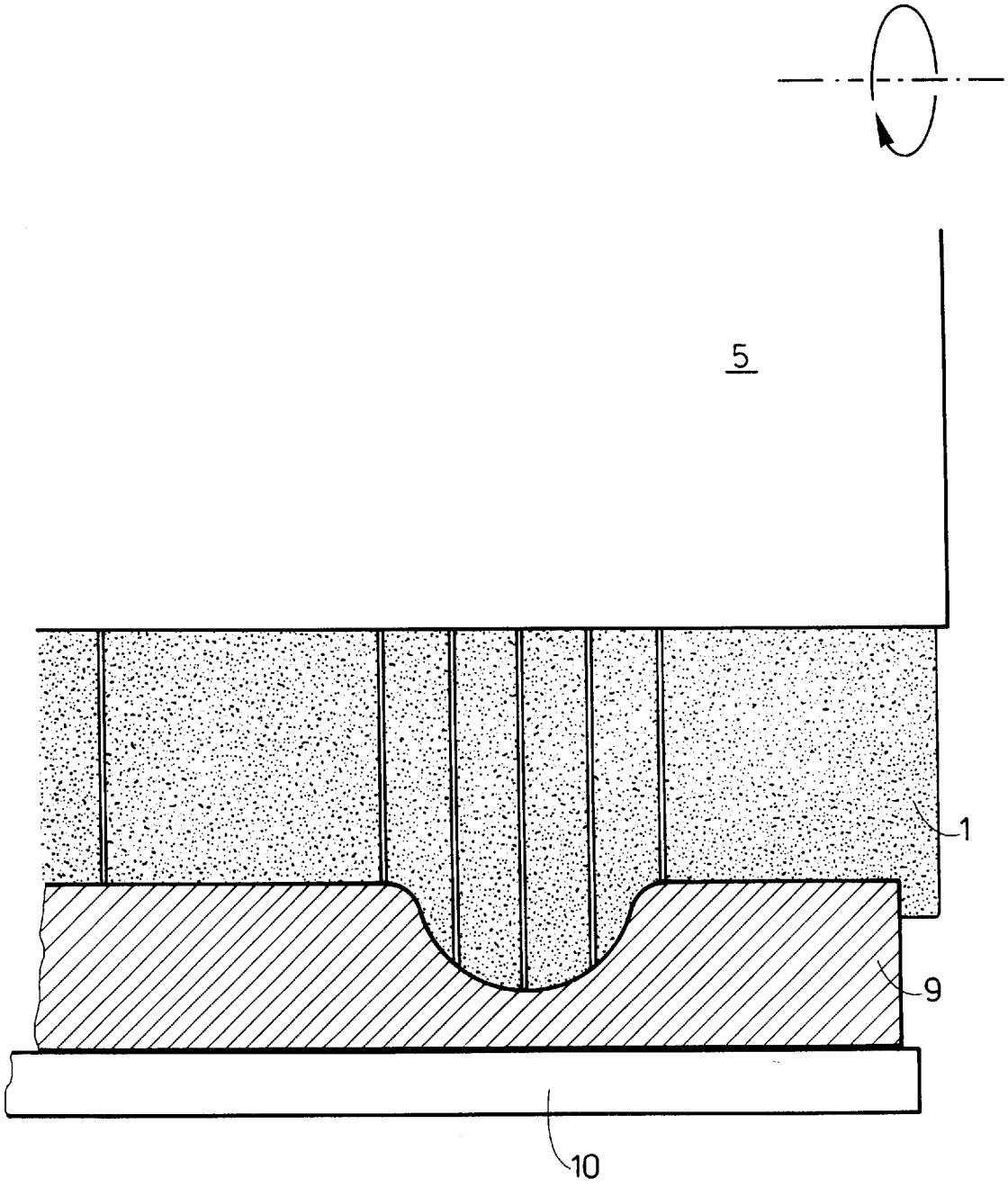
Figure 4:
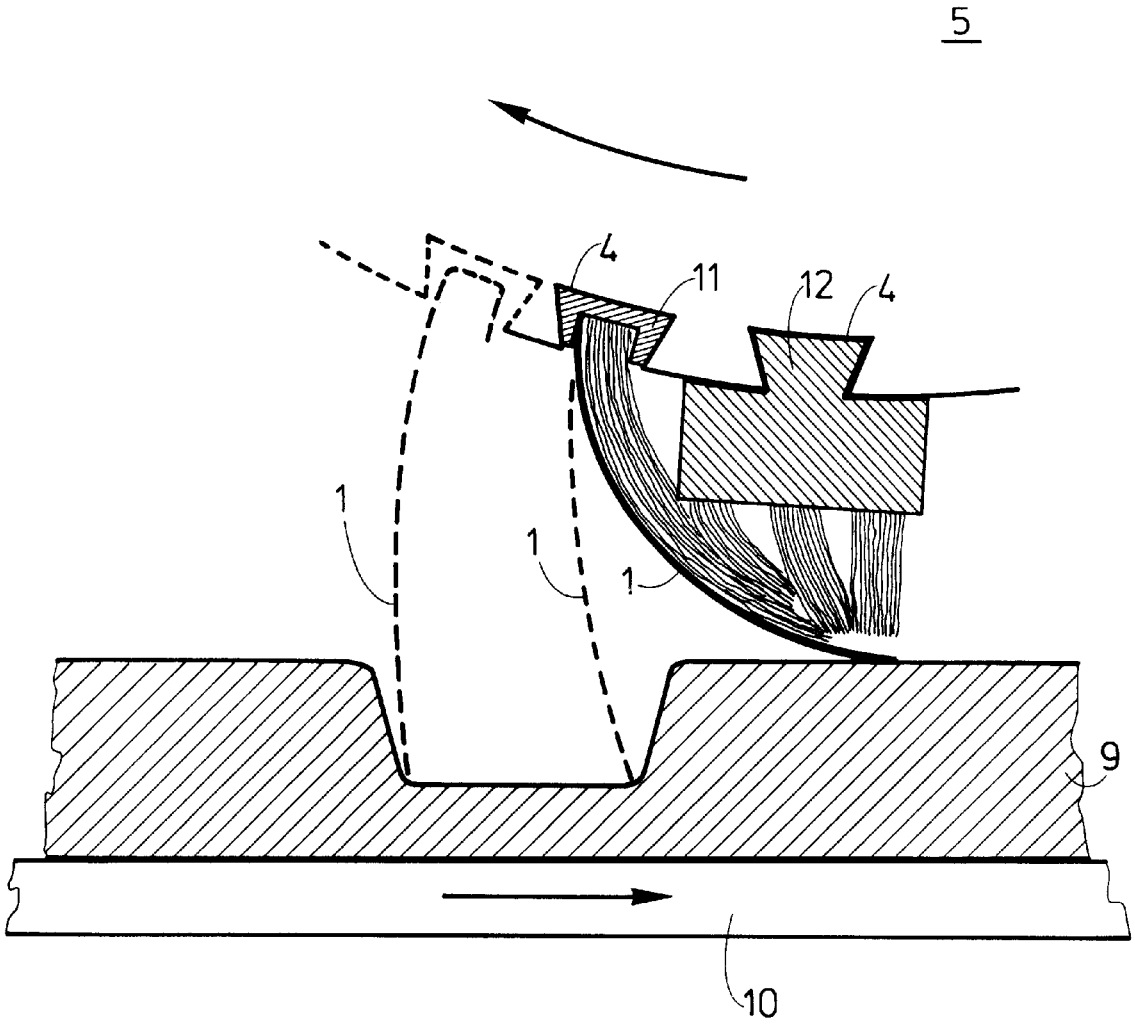
Figure 5:
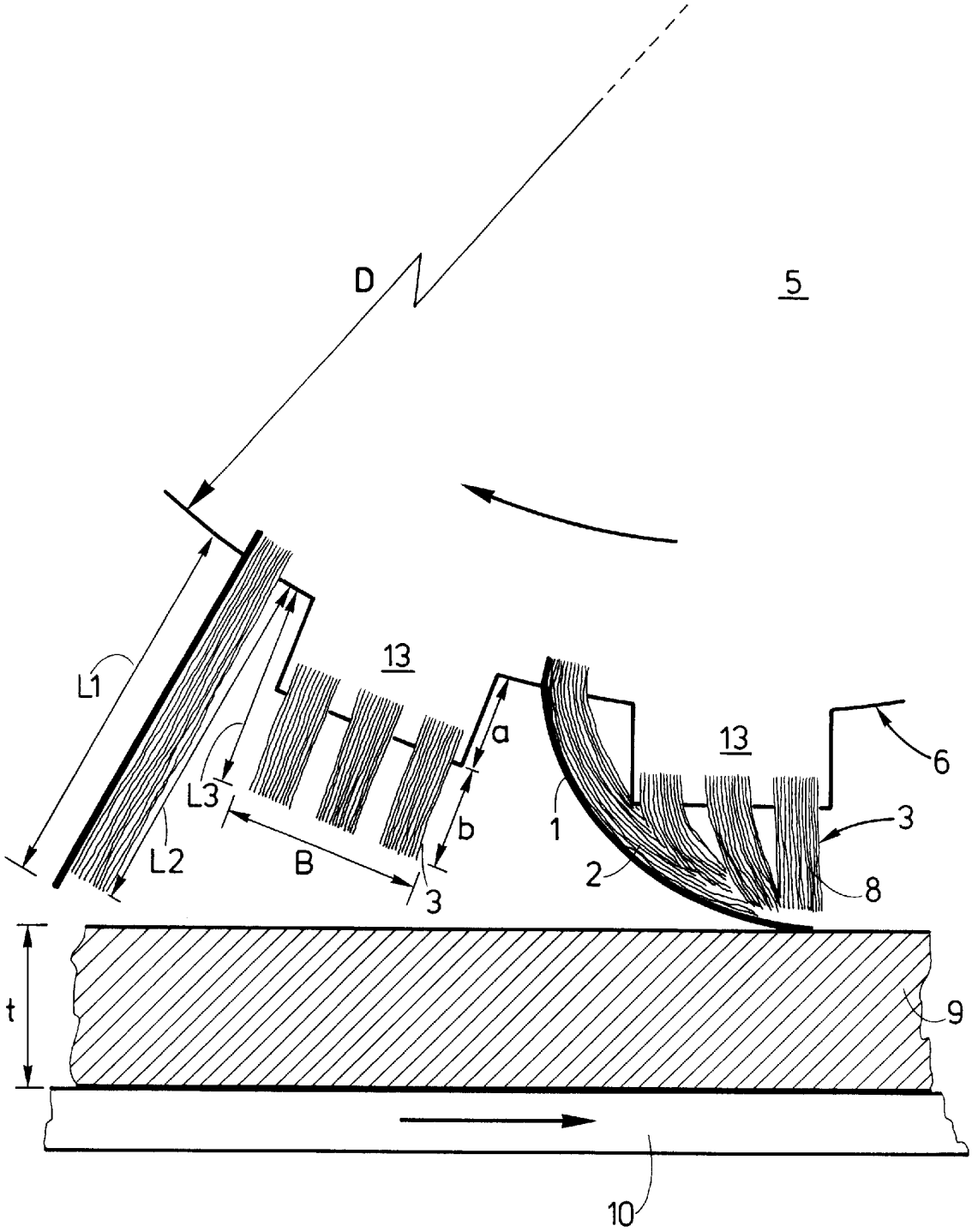

The invention is now described in more detail with reference to the accompanying drawing, where FIG. 1 is a partial section through an embodiment of a rotatable polishing tool according to the present invention, used for polishing a plane item, FIG. 2 is partial plane view of an embodiment of a tool according to the invention and an item being polished as seen in parallel with a direction of movement of the item and perpendicularly to an axial direction of the tool, FIG. 3 is a view corresponding to FIG. 2, but illustrating a further embodiment of the tool, FIG. 4 is section corresponding to FIG. 1, but illustrating polishing of a profiled item, and FIG. 5 is a section through a further embodiment of a tool according to the invention, where grinding elements and holding elements are fastened directly in the cylinder surface of the tool.

FIG. 1 shows a section through the periphery of a tool with grinding/polishing flaps 1, reinforcing support brushes 2, and holding elements 3 in the shape of additional brushes. An intermediate grinding of a varnished, plane surface of a wood item is illustrated.

The flaps 1 and the reinforcing support brushes 2 are fastened in mouldings 11 mounted in grooves 4 in the roller 5 itself of the rotatable tool. The grooves 4 are extending axially and perpendicularly to the plane of the paper. The flaps 1 may assume different lengths L1 measured from a cylinder surface 6 of the roller 5 of the rotatable tool itself, e.g. between 45 and 55 mm. The reinforcing support brushes 2 may correspondingly assume different lengths L2 measured from the cylinder surface 6 of the roller 5 itself, e.g. lengths between 40 and 50 mm, depending on the length L1 of the flaps 1. The holding brushes 3 will assume considerably shorter lengths L3 counted from the cylinder surface 6 of the roller 5 itself, e.g. lengths L3 of between 25 and 35 mm. The length L3 of the holding brushes will be accommodated to the width B of the holding brushes in order to achieve sufficient tangential stiffness of the holding brushes. The width B of the holding brushes is between 20 and 25 mm.

In the embodiment shown, the holding brushes 3 are fastened in brush holders 7 provided with an undercut 12 which may be accommodated and fixed in the grooves 4 in the roller 5 itself of the rotating tool. The brush holder 7 itself extends radially outwards at a certain distance a from the cylinder surface 6 of the roller 5 itself, and brush hairs 8 in the holding brush 3 extend over a further certain distance b radially outward of the brush holder 7. By using a brush holder 7 as shown, it is possible to exchange the holding brush 3 when other items 9 with another surface or other varnish are to be ground or polished. Furthermore, there is achieved a relatively stiff holding brush 3 as the brush hairs 8 only extend over the distance b and thus are very short.

The length L1 of the flaps 1 is such that when the flaps 1 are bent backward by grinding or polishing, they 1 may extend backward over a distance so that the flaps cover the width B of the holding brushes 3. The length L1 of the flaps 1 will also depend on the thickness t of the ground or polished item 9 and on whether the item is clamped to a fixed table 10 or whether the item is passed by the tool on rollers (not shown) which are staggered in relation to the tool, possibly a plurality of rollers disposed between several succeeding tools. A distance C between the flaps and the leading edge of the holding brushes 3 and within which distance the reinforcing support brushes 2 are located may vary, but will be between 5 and 15 mm.

Preferably, the diameter D of the roller 5 itself will be greater than that of prior art tools. The diameter D has preferably such dimension that the diameter between diametrically opposite outer ends of the flaps 1 is between 310 and 390 mm. The roller 5 may be made of plastic or metal. In a preferred embodiment, the roller 5 is made of plastic and provided with end coverings of aluminium, which reduces the risk of static electric charges developing between the item and the brushes. The grooves in the roller for mounting flaps, reinforcing support brushes and holding elements are undercut in order to hold these elements firm to the roller during rotation of the tool.

Grinding or polishing with the tool takes place by the rotatable tool being imparted clockwise rotation as shown with the arrow in the roller, and the item 9 is imparted a translational displacement in a direction of movement as shown with the arrow under the item. At the same time, the tool is forced downward against the item. How strongly the tool is forced downwards against the item depends on the kind of varnish and thickness of varnish applied. The force will depend on the kind of wood for items 9 that are not varnished.

By light pressure there are largely only the reinforcing support brushes 2 for establishing a pressure from the flaps 1 downward against the item 9. By larger pressure, as shown, there are both the reinforcing support brushes 2 and the leading holding brush hairs 8 establishing the pressure of the flaps 1 against the item 9. By still larger pressure there are also the reinforcing support brushes, but primarily all the holding brush hairs 8, establishing the pressure on the flaps 1 downward against the item. The downward pressure of the flaps depends on the elastic stiffness of the reinforcing support brushes and of the holding brushes.

FIG. 2 shows polishing an item 9 with a plane surface. There is used a tool where the flaps 1 have a uniform width over the whole axial length of the tool.

FIG. 3 differs by showing polishing of an item 9 with a profiled surface as seen in parallel with a direction of movement of the item 9. The number and width of the flaps 1 are chosen selectively for the item in question. The item has a largely plane surface which is broken by a groove longitudinally of the item. Within the transverse extension of the groove, the polishing flaps are narrow, and transversely of the remaining part of the surface, the flaps are broad and extend laterally outward beyond an outer edge of the item. The broad flaps will have great resistance to lateral bending and hence will provide for the outer edges of the item remaining sharp. The narrow flaps will have small resistance to lateral bending and will thereby better accommodate to the contour of the groove. This implies that the groove will maintain its rounded shape. At the same time, the narrow flaps may also protrude down into the groove, which is not the case with broad flaps that possibly may have widths larger than the width of the groove in the item.

FIG. 4 shows polishing an item 9 with a profiled surface as seen perpendicularly to a direction of movement of the item. The item has a largely plane surface broken by a groove traversing the item. When the flaps 1 are passed by such a traversing groove, the flaps 1 are moved past the traversing groove with substantially lower speed that in known tools because of the substantially lower rotational speed. This implies that the flaps 1 will have time to be moved sufficiently deep into the groove, as shown with stippled contour, and thereby grind or polish all of the groove before the flaps are drawn free of the groove again.

FIG. 5 shows a tool where the grinding elements 1,2 and the holding brushes are fastened directly into the material of which the roller 5 is made. This tool is a disposable tool which is disposed of when the grinding/holding elements are worn down. It is advantageous to let brush hairs 8 in holding brushes 3 be mounted in raised ribs 13. Hereby there is achieved possibility of using short brush hairs 8 corresponding to the embodiment shown in FIGS. 1 and 4.

The invention is described above with reference to a specific mutual length, width and location of the flaps 1, reinforcing support brushes 2 and holding brushes 3. Lengths of and distances for and between each of the means may be varied arbitrarily in view of the item to be ground or polished, in view of the used kind of varnish and thickness of varnish, and in view of the desired polishing quality and speed. The axial length of the roller itself may vary with regard to the width of the item. The rotational speed of the tool may also vary in view of the other, previously mentioned factors.

The tool according to the invention is particularly advantageous for polishing varnished surfaces, but may also be used for grinding unvarnished surfaces on wood items.

What is claimed is:

1. A rotatable grinding or polishing tool with grinding elements each mounted in a cylinder surface, said grinding elements comprise flaps of abrasive cloth which have an extension and support brushes having substantially, a radial extension which is the same as the flap extensions and provided in close contact with said flaps, characterized in that between each grinding element there is provided a holding element which has substantially shorter radial extension than said grinding elements and which comprises holding means with a substantially greater stiffness in tangential direction than the support brushes.

2. A tool according to claim 1, characterized in that the holding element is an additional brush and that the holding means are brush hairs.

3. A tool according to claim 1, characterized in that flaps and brushes on said grinding element have a radial length corresponding to the radial length on the holding means plus the width of the holding means.

4. A tool according to claim 1, characterized in that the diameter of outer ends of the grinding elements is between 250 and 450 mm, preferably between 310 and 390 mm, and that the diameter of the outer ends of the holding means are between 10 and 50 mm less than the corresponding said grinding elements.

5. A tool according to claim 1, characterized in that the length of brushes and flaps of said grinding element is between 40 and 60 mm, preferably between 45 and 55 mm, that the length of the holding means on the holding element is between 20 and 45 mm, preferably between 25 and 40 mm, and that a width of the holding element is between 15 and 30 mm, preferably between 20 and 25 mm.

6. A tool according to claim 1, characterized in that the grinding elements and the holding elements are exchangeable and are fastened in mouldings that may be accommodated in undercut grooves in the cylinder surface.

7. An apparatus comprising support means for advancing an item with a certain thickness to be ground or polished and a rotatable grinding or polishing tool mounted above the support means and having grinding elements that are mounted in a cylinder surface, the grinding elements comprising flaps of abrasive cloth which have an extension and support brushes which have substantially a radial extension which is the same as the flap extensions and which are provided in close contact with these flaps, characterized in that between each said grinding element there is provided a holding element having substantially shorter radial extension than the grinding elements and comprising holding means with a substantially greater stiffness in tangential direction than the support brushes.

8. An apparatus according to claim 7, characterized in that the grinding flaps and the support brushes extend radially beyond the holding means at a distance which is less than the thickness of the item to be ground/polished.

9. A method for grinding substantially plane items by using a grinding or polishing tool according to any preceding claim which is pressed against the item, characterized in that the tool is pressed against the item with such a force that the grinding flaps and the support brushes are bent in over an upper side of the holding element.

10. A method according to claim 9, characterized in that the grinding is performed as an intermediate grinding of a varnished item.

* * * * *